US005199607A

United States Patent [19]

Shimano

[11] Patent Number: 5,199,607

[45] Date of Patent: Apr. 6, 1993

[54] LIQUID DISPENSING APPARATUS

[75] Inventor: Ichiro Shimano, Tokyo, Japan

[73] Assignee: Musashi Engineering, Inc., Mitaka, Japan

[21] Appl. No.: 879,146

[22] Filed: Apr. 30, 1992

Related U.S. Application Data

[63] Continuation of Ser. No. 621,514, Dec. 3, 1990, abandoned.

[51] Int. Cl.[5] ..... B67D 5/08

[52] U.S. Cl. ..... 222/55; 222/638; 425/146

[58] Field of Search ..... 222/14, 52, 55, 57, 222/61, 71, 108, 394, 396, 638, 639, 644, 649; 425/135, 146, DIG. 1; 261/40.3, 40.7; 137/14, 147

[56] References Cited

U.S. PATENT DOCUMENTS

| | | | |
|---|---|---|---|
| 2,710,115 | 6/1955 | Chandler | 222/61 |
| 3,708,088 | 1/1973 | Lesher | 222/394 X |
| 4,810,659 | 3/1989 | Higo et al. | 222/309 X |
| 4,989,756 | 2/1991 | Kagamihara et al. | 222/55 |

FOREIGN PATENT DOCUMENTS

| | | | |
|---|---|---|---|
| 1435806 | 3/1966 | France | 222/399 |
| 63-97259 | 4/1988 | Japan . | |

*Primary Examiner*—Andres Kashnikow
*Assistant Examiner*—Philippe Derakshani
*Attorney, Agent, or Firm*—Dvorak and Traub

[57] ABSTRACT

A liquid dispensing apparatus comprises a syringe containing liquid to be dispensed and an air supply for supplying compressed air to the syringe. The syringe is connected to the compressed air supply via a discharging solenoid valve by means of a pipe line which is provided with an accumulator so as to prevent disturbance of stand-up of the pressure in the syringe to thereby effect a highly accurate quantitative discharge of liquid from the syringe independent of whether a quantity of liquid remaining in the syringe is much or less. The apparatus further comprises an air suction connected to the discharge solenoid valve by means of an additional pipe line provided with an accumulator to prevent liquid from dropping out of the syringe after the end of discharge of liquid.

9 Claims, 2 Drawing Sheets

LIQUID DISPENSING APPARATUS

This application is a continuation of application Ser. No. 07/621,514, filed Dec. 3, 1990, now abandoned.

BACKGROUND OF THE INVENTION (1) Field of the Invention

The present invention relates to a liquid dispensing apparatus adapted for accurately metering and discharging a predetermined quantity of liquid including viscous fluid such as paste-like materials, adhesives and the like.

(2) Related Art Statement

Hitherto, such a liquid dispensing apparatus has been generally used in, for example, a die bonding machine to discharge a paste on a lead frame or a circuit substrate from a syringe in a constant quantity in order to bond a die on the frame or substrate with a base.

In this case, a quantitative discharge of the paste from the syringe is effected by supplying compressed air to the syringe which is filled with the paste. In a conventional paste dispensing apparatus, in order to control the air supply to the syringe, a discharging solenoid valve is arranged between the syringe and a compressed air supply and is controlled to open it for a predetermined duration.

However, the conventional paste dispensing apparatus as mentioned above is adapted for controlling only the discharging solenoid valve to open it for the predetermined duration and, as a result, the quantity of the paste discharged from the syringe is varied depending on a quantity of paste remaining in the syringe in spite of a constant compressed air supply duration.

If the paste is not transparent or the syringe is opaque or even if the paste is transparent, an operator cannot accurately confirm the remaining quantity of the paste by visual observation. In such a case, hitherto the remaining quantity of the paste in the syringe has been indirectly detected from a quantity of the paste squeezed out of the sides of the die at a die bonding process after the paste was discharged on a lead frame by the syringe. Then, the operator is required to reset the duration of the supplied compressed air or the set pressure of compressed air to an adequate value based on the detected remaining quantity of the paste.

Furthermore, if the operator cannot confirm the remaining quantity of the paste because the paste itself or the syringe is not transparent as mentioned above, and/or the operator is not watching the syringe when the die bonding machine is automated, the die bonding machine can be operated to such a state that the syringe contains little or no paste, so that the paste cannot be sufficiently discharged to be bonded at the subsequent die bonding process.

The conventional liquid dispensing apparatus of the prior art further has a disadvantage that the gravity causes the paste to drop little by little from the tip of the syringe during the stoppage of the apparatus.

In order to settle the aforementioned problems, there has been proposed a paste dispensing apparatus as disclosed in Japanese Patent Application Laid-open Publication No. 63-97,259.

This paste dispensing apparatus comprises a syringe containing a paste or the like, an air supply for supplying air under a positive pressure to the syringe, a discharging solenoid valve arranged between the syringe and the air supply and connected to the syringe by means of a first pipe line and to the air supply by means of a second pipe line for communicating the syringe with the air supply when the paste is discharged from the syringe, a first pressure sensor for measuring a pressure in the first pipe line, a second pressure sensor for measuring a pressure in the second pipe line, and a controller having inputs for signals of measured pressure from the first and second pressure sensors, outputs of voltage signals for actuating the discharging solenoid valve t communicate the first and second pipe lines with each other at the start of discharge and a control unit for controlling a duration of the output voltage signal by the time spent until the pressure measured by the first pressure sensor reaches a preset pressure after the first and second pipe lines are communicated to each other.

The aforementioned paste dispensing apparatus may further comprise an air suction for supplying air under a negative pressure to the first pipe line. The air suction is connected to said discharging solenoid valve via a third pipe line so as to communicate with the first pipe line while the first and second pipe lines do not communicate with each other.

The former apparatus mentioned above feeds a voltage signal from the controller, upon the discharge, to actuate the discharging solenoid valve, thereby supplying a positive air pressure from the air supply to the syringe to discharge the paste from the syringe. At this time, a build-up variation in the pressure measured by the first pressure sensor caused by the remaining quantity of paste in the syringe is estimated by the control unit. Correspondingly, a duration of an output signal from the control unit to the discharging solenoid valve, i.e., the discharging duration, is controlled so that the quantity of the paste discharged from the syringe is constant in spite of variation of the remaining quantity of the paste. Consequently, the paste can be discharged from the syringe with a constant quantity in spite of the remaining quantity of the paste in the syringe. Moreover, the latter paste dispensing apparatus can timely supply a negative pressure from the air suction to the syringe at the end of the discharge, thereby preventing the paste from dropping out of the syringe.

However, the former apparatus has disadvantages that pressure in the first and second pipe lines at the beginning of discharge is varied and directly influenced with variation of supply pressure of the air supply until the inner pressure in the syringe has reached the set pressure after a moment of communicating the syringe with the air supply, so that a building-up wave shape of a signal of the inner pressure in the syringe measured by the first pressure sensor is greatly disturbed and, as a result, the inner pressure cannot be measured by the first pressure sensor, and hence a discharge duration cannot be controlled by the control unit with high accuracy.

The latter apparatus also has disadvantages that time is required for reducing the inner pressure in the syringe to a predetermined negative pressure since a moment of communicating the syringe with the air suction after the paste has been discharged is directly influenced by the amount and pulsation of negative pressure supplied from the air suction, so that the weight of paste in the syringe cannot be quickly offset by the negative pressure. In other words, the dropping of the paste cannot be quickly prevented without a delay at the end of discharge of the paste.

SUMMARY OF THE INVENTION

An object of the present invention is to remove all the disadvantages of the aforementioned prior art and to improve such a liquid dispensing apparatus so as to discharge a constant quantity of liquid independent of whether a large or small quantity of liquid remains in the syringe by detecting the quantity of liquid remaining in the syringe as well as to improve the liquid discharge accuracy by removing the influence of variation of the supply pressure from the air supply when the liquid is discharged out of the syringe to provide a very smooth building-up wave shape.

Another object of the present invention is to improve such a liquid dispensing apparatus so as to supply a predetermined negative pressure to the syringe without delay when the syringe is communicated with an air suction to prevent liquid from dropping out the syringe at the end of discharge of liquid.

According to one aspect of the present invention, there is provided a liquid dispensing apparatus comprising a syringe containing liquid to be dispensed, an air supply for supplying compressed air to the syringe, a discharging solenoid valve arranged between the syringe and the air supply and connected to the syringe by means of a first pipe line and to the air supply by means of a second pipe line for communicating the syringe with the air supply when the liquid is discharged out of the syringe, an accumulator connected to the second pipe line, a first pressure sensor for measuring pressure in the first pipe line, a second pressure sensor for measuring pressure in the second pipe line, and a controller connected to the first and second pressure sensors for feeding a signal to the discharging solenoid valve so as to communicate the first pipe line with the second pipe line and for controlling an output duration of the signal in accordance with a variation of time until the pressure in the first pipe line measured by the first pressure sensor reaches a predetermined pressure after the first pipe line is communicated with the second pipe line.

According to a second aspect of the present invention, the liquid dispensing apparatus mentioned above further comprises an air suction connected to the discharging solenoid valve by means of a third pipe line adapted for communicating with the first pipe line except when the first pipe line is communicated with the second pipe line, and an accumulator connected to the third pipe line.

In operation of dispensing liquid from the syringe, the controller outputs a voltage signal to the discharging solenoid valve to supply compressed air from the air supply to the syringe.

At this time, a variation of standing up of pressure caused by a quantity of liquid remaining in the syringe is measured by the first pressure sensor and is estimated in the controller. The controller controls a duration for opening the discharging solenoid valve, and thence a discharge duration corresponding to the condition of the standing up of the measured pressure so as to maintain the quantity of liquid discharged from the syringe to be uniform in spite of variation of the quantity of liquid remaining in the syringe.

With the apparatus according to the second aspect of the present invention, a negative pressure can be applied to the syringe from the air suction in time to stoppage of supplying compressed air to the syringe to thereby prevent the liquid from dropping out of the syringe.

According to the present invention, the standing up of the measured pressure can be very smoothly performed by supplying compressed air from the accumulator at the beginning of supplying of compressed air even if the supply pressure from the air supply varies, and, therefore, the duration of the output signal can be more accurately controlled.

Moreover, the apparatus according to the second aspect of the present invention comprises a vacuum accumulator connected to the third pipe line and, therefore, the syringe can be quickly reduced to the predetermined negative pressure without any influence by an order of negative pressure applied by the air suction or pulsation thereof, and the variation of the inner pressure in the syringe caused by the pulsation in the air suction can be prevented by the accumulator to thereby effectively prevent the liquid from dropping out of the syringe.

BRIEF DESCRIPTION OF THE DRAWINGS

The present invention will become apparent as the following description of illustrative embodiments proceeds with reference to the drawings, in which.

DETAILED DESCRIPTION OF THE PREFERRED EMBODIMENTS

Figure 1:
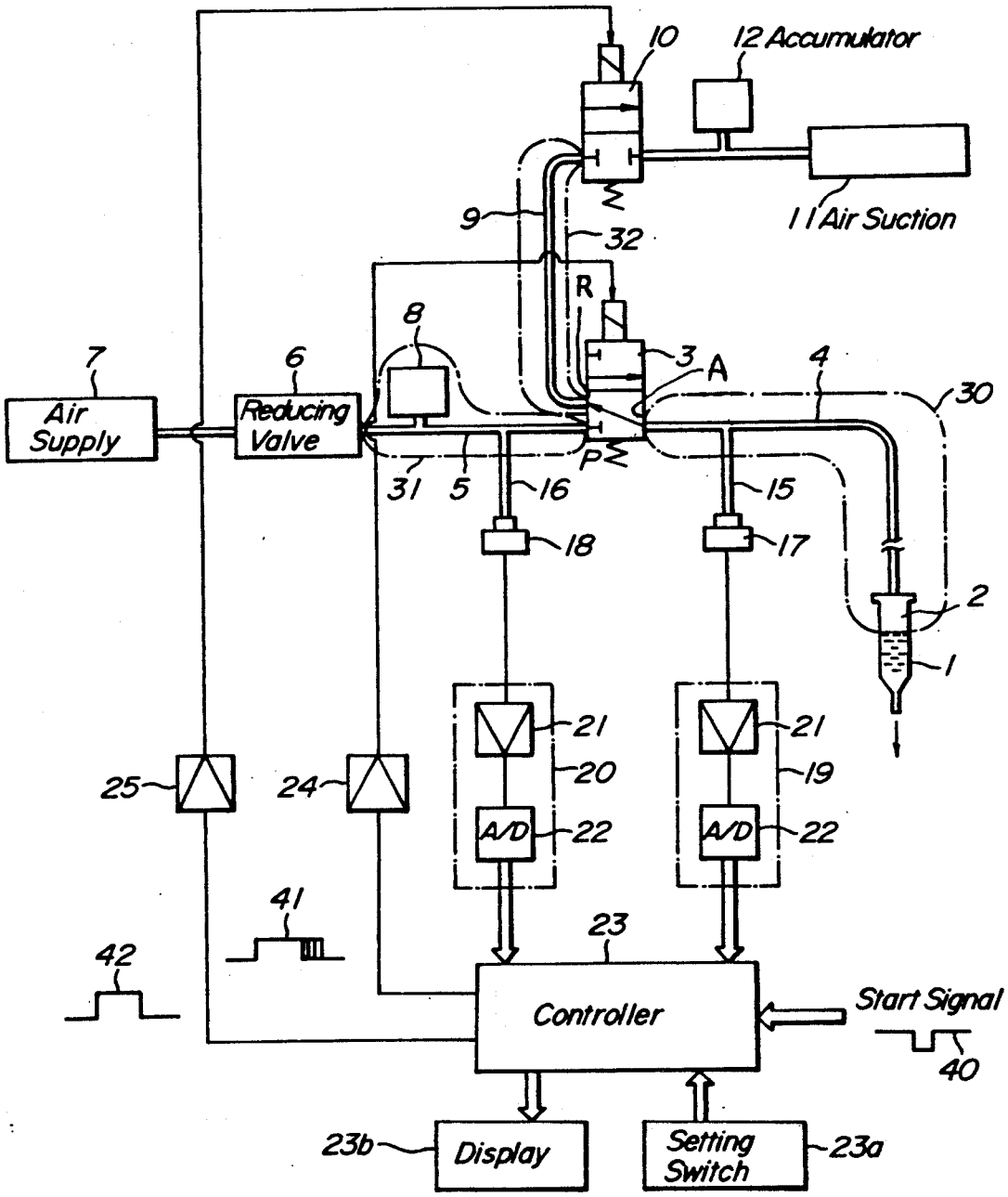
FIG. 1 is a circuit diagram according to an embodiment of the present invention.

With reference to FIG. 1, showing a circuit diagram according to an embodiment of the present invention, syringe 2 contains a liquid 1 which will be dispensed. The syringe 2 is connected to a port "A" of a discharging solenoid valve 3 which has three ports, by means of a first pipe line 4.

When the solenoid valve 3 is deenergized, the port "A" communicates with an outlet port "R", and when the solenoid valve 3 is energized, the port "A" communicates with an inlet port "P".

The inlet port "P" of the discharging solenoid valve 3 is connected to an air supply 7 via a reducing valve 6 by means of a second pipe line 5, to which is connected an accumulator 8 which is interposed between the discharging solenoid valve 3 and the reducing valve 6. The outlet port "R" of the discharging solenoid valve 3 is connected to one of two ports of a suction solenoid valve 10 by means of a third pipe line 9. The other port of the suction solenoid valve 10 is connected to an air suction 11. A negative pressure accumulator 12 is interposed between the suction solenoid valve 10 and the air suction 11.

The suction solenoid valve 10 has a closed position upon being deenergized and an open position upon being energized.

The first and second pipe lines 4 and 5 are connected with first and second pressure sensors 17 and 18 by means of pipe lines 15 and 16, respectively. Each of the pressure sensors 17 and 18 detects individual pressure and converts it to an electrical signal and then inputs the signal to each of conversion circuits 19 and 20. These conversion circuits 19 and 20 include amplifier circuits 21 for amplifying and calibrating the output signals from the pressure sensors 17 and 18, and A/D convertors 22 for converting analog signals of the measured pressure to a plurality of binary digital signals. The convertor circuits 19 and 20 provide output signals to a controller 23 comprising a microprocessor or one chip computer.

For simplifying the following description, it is assumed that a space 30 includes the space above the liquid 1 in the syringe and includes spaces in the pipe lines 4 and 15. A space 31 includes a space between the discharging solenoid valve 3 and the reducing valve 6 in the pipe line 5 and a space in the pipe line 16. A space 32 is a space between the discharging solenoid valve 3 and the suction solenoid valve 10 and the space in pipe line 9.

The controller 23 provides a voltage signal 41 upon receiving a discharge start signal 40. The voltage signal 41 is amplified in an amplifier circuit 24 and then fed to the discharging solenoid valve 3. The controller 23 also provides a voltage signal 42 at the end of a discharge. The voltage signal 42 is amplified in an amplifier circuit 25 and then fed to the suction solenoid valve 10.

The controller itself is provided with a setting switch 23*a* for setting time conditions and a set data display 23*b*. The setting switch 23*a* comprises a switch for setting an open time of the discharging solenoid valve 3 required for discharging a predetermined quantity of liquid 1. The switch also provides for adjusting the discharge duration corresponding to the variation in the space 30 in accordance with variation of the remaining quantity of the liquid in the syringe. The switch provides for setting an open time of the suction solenoid valve 10 since the end of discharge, and for setting a negative pressure required in the space 30.

The set data display 23*b* displays the time, conditions or the other data set by the setting switch 23*a*, and the pressures in the spaces 30 and 31 detected by means of the pressure sensors 17 and 18.

Operation of the apparatus mentioned above will now be explained.

Usually, the discharging solenoid valve 3 is in a position that the port "A" communicates with the outlet port "R", and, therefore, the pressure in the space 30 is kept to the same pressure as that in the space 32. The pressure in the space 31 is kept at a predetermined pressure by regulating the compressed air from the air supply 7 by means of the reducing valve 6.

The pressure in the space 30 is detected and converted to an electrical signal by means of the pressure sensor 17, and the signal is fed to the convertor circuit 19. In this convertor circuit 19, the output signal from the pressure sensor 17 is amplified by the amplifier 21 and converted to a digital signal by the A/D convertor 22 and then fed to the controller.

The controller 23 displays the signal from the convertor circuit 19 in the set data display 23*b*. The pressure in the space 31 also is detected and converted to a voltage signal by means of the pressure sensor 18 and introduced via the convertor circuit 20 to the controller 23. The controller 23 displays the signal from the convertor circuit 20 in the set data display 23*b* and feeds a control signal for maintaining the pressure in the space 31 at a predetermined constant pressure by means of the reducing valve 6.

Under the above condition, the discharge start signal 40 is fed to the controller 23 to thereby provide a voltage signal 41 from the controller 23. The voltage signal 41 is amplified in the amplifier circuit 24 and then applied to the discharging solenoid valve 3. Therefore, the port "A" now communicates with the inlet port "P" in the discharging solenoid valve 3 to apply the pressure in the space 31 to the space 30. Thus, compressed air is supplied to the syringe 2 to begin to discharge the liquid 1.

The time required for equalizing the pressure in the space 30 (a pressure detected by the pressure sensor 17) with the pressure in the space 31 (a pressure detected by the pressure sensor 18) varies depending on the quantity of the liquid remaining in the syringe 2. This relationship is shown in FIG. 2.

Figure 2:
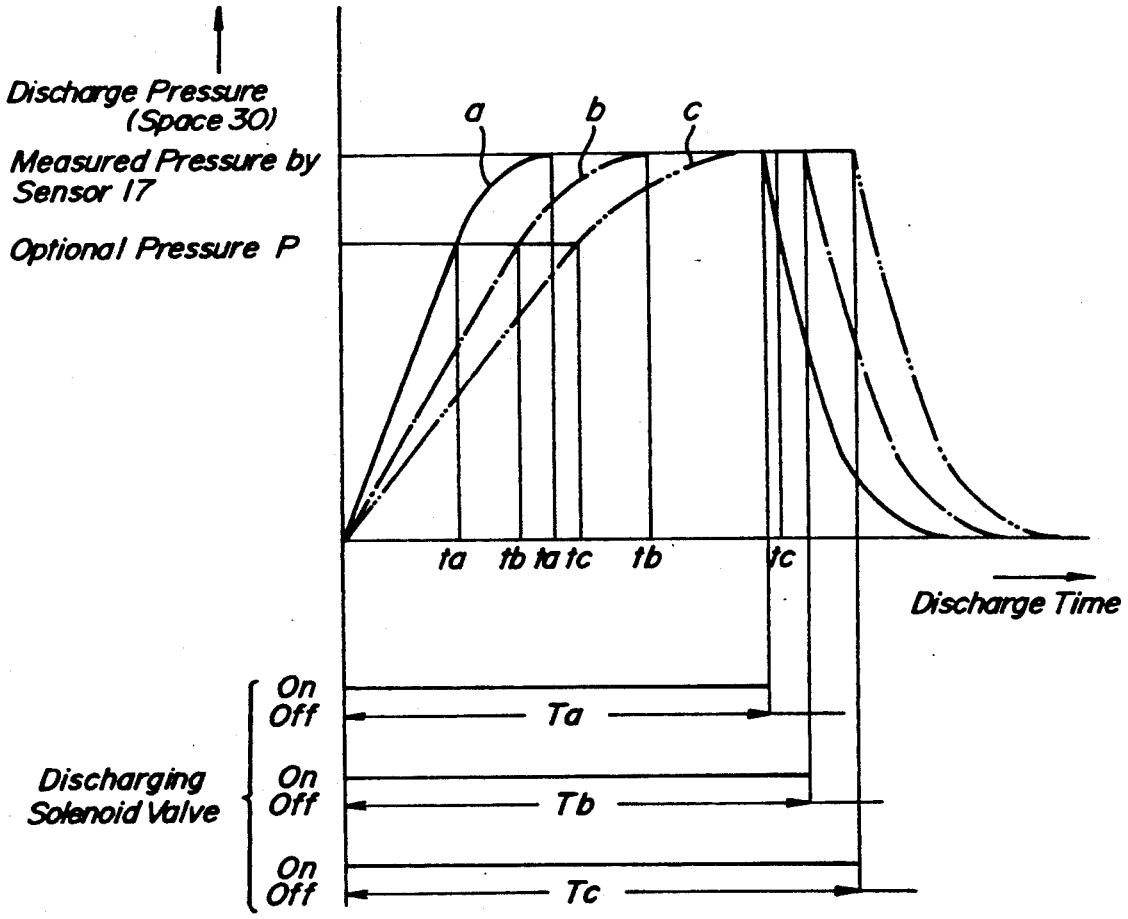
FIG. 2 is a graph showing a relationship between discharge pressure and discharge duration.

Referring to FIG. 2, the ideal stand-up conditions of pressure measured by the pressure sensor 17 are shown by a curve "a" in the case of the syringe 2 being fully filled with a liquid. A curve "b" refers to the case of the syringe 2 being filled with a lesser liquid quantity. A curve "c" refers to the case of the syringe 2 containing even less liquid than the case of the curve "b". Times required for equalizing the pressures measured by the pressure sensor 17 with the pressures measured by the pressure sensor 18 in the curves "a", "b", and "c" are shown by $ta_1$, $tb_1$ and $tc_1$, respectively. Durations (discharge durations) that the discharging solenoid valve 3 is energized by the voltage signal 41 are shown by Ta, Tb and Tc.

It will be seen from FIG. 2 that the time required for equalizing the pressure in the space 30 with the pressure in the space 31 takes longer as the remaining quantity of liquid 1 in the syringe 2 decreases.

Thus, a relationship between the remaining quantity of liquid 1 in the syringe 2 and the time spent until the pressure measured by the pressure sensor 17 reaches the pressure measured by the pressure sensor 18 is previously examined and stored in the controller. When the remaining quantity of the liquid 1 in the syringe 2 is small, the time to evacuate the syringe 2 may be anticipated and preset in the controller in such a manner that, if the preset time coincides with an actually reached time, the set data display 23*b* can be displayed. Thus, the time to evacuate the syringe can be easily known.

Moreover, the durations (discharge time) Ta, Tb and Tc of applying the voltage signals to the discharging solenoid valve may be set in the following manner. In FIG. 2, arrival times of the curves "a", "b" and "c" to a set pressure "P" of the pressure sensor 17 in a range where all the curves "a", "b" and "c" are straight are ta, tb and tc. For example, in the case of the curve "a", the discharge time Ta for discharging a predetermined quantity of liquid 1 from the syringe 2 is experimentally determined. Then, the discharge times Tb and Tc in the case of the curves "b" and "c" are determined by the following formulas, $$Tb = Ta + n(tb - ta)$$

$$Tc = Ta + n(tc - ta)$$

That is, the above formulas can be expressed in the following generic formula, $$T = Ta + n(t - ta)$$

wherein n is a constant which can be experimentally determined by the viscosity of the liquid, lengths and diameters of the pipe lines 4 and 15, and the volume of the syringe 2. The above generic formula is based on Ta, but also is based on Tb or Tc.

The above generic formula is previously stored in the controller 23 together with the remaining quantity of liquid 1 in the syringe 2. The output time T(Ta, Tb, Tc) of the voltage signal 41 to be applied to the discharging solenoid valve 3 can be controlled in the controller 23 in accordance with the remaining quantity of the liquid to discharge the predetermined constant quantity of liquid 1.

When the remaining quantity of liquid in the syringe is detected and the output time of the voltage signal 41 to be applied to the discharging solenoid valve 3 is controlled, as mentioned above, it is important to prevent the pressure in the space 31 from dropping below the preset pressure. Accordingly, in the embodiment, an accumulator 8 is arranged in the second pipe line 5 at the downstream side of the reducing valve 6 to accurately maintain the pressure in the space 31 at the preset pressure until the pressure in the space 30 reaches the same pressure as that in the space 31. A comparative accuracy of the pressure in the spaces 30 and 31, therefore, is improved.

When the voltage signal 41 is off and when the discharging solenoid valve 3 is deenergized, the port "A" of the discharging solenoid valve 3 communicates with the outlet port "R", and then the space 30 communicates with the space 32, and consequently, the pressure in the syringe 2 drops to thereby stop the discharge of liquid 1 from the syringe 2.

At this time, the voltage signal 42 is fed from the controller 23 simultaneously or immediately before the voltage signal 41 is off. The voltage signal 42 is amplified in the amplifier circuit 25 and then applied to the suction solenoid valve 10. The suction solenoid 10 then is opened to communicate with the space 32 and with the air suction 11 to thereby reduce the pressure in space 32.

Thus, at the end of discharge of liquid 1, the space 30 communicates with the space 32 to thereby reduce the pressure in space 30 to a negative pressure. This negative pressure in the space 30 is measured by the pressure sensor 17. When the measured pressure reaches the predetermined pressure, the voltage signal 42 is off and consequently the suction solenoid valve 10 is closed.

When the predetermined quantity of the liquid 1 has been discharged, the space 30 is reduced to a negative pressure as mentioned above to thereby prevent the liquid 1 from dropping out of the syringe 2.

In the present embodiment, immediately after both the solenoid valves 3 and 10 are simultaneously actuated or the discharging solenoid valve 3 is actuated when the suction solenoid valve 10 is previously opened, the accumulator 12 in the third pipe line 9 serves to reduce the pressure in the space 30 to a negative pressure to thereby remove the possibility of pulsation until the pressure in the space 30 has reached the negative pressure. Thus, the stability of the negative pressure is greatly improved, and particularly any accidental leak of the liquid 1 out of the syringe during the time until the pressure in the space 30 has reached the negative pressure.

If the space 30 can be maintained in a completely closed condition, the liquid 1 in the syringe is prevented from leaking for a long time by the means mentioned above. However, actually some leaking occurs in the space 30 caused by poor air tightness in the discharging solenoid valve 3 so that the pressure in the space 30 is returned to the atmospheric pressure after a time to thereby cause the liquid 1 to leak from the top of the syringe 2. Thus, when the pressure in the space 30 measured by the pressure sensor 17 approaches atmospheric pressure rather than the preset negative pressure, the controller 23 will feed the voltage signal 42 to open the suction solenoid valve 10 again to thereby keep the negative pressure in the space 30.

Thus, according to the present invention, the second pipe line 5 is provided with an accumulator 8 to make the stand-up pressure in the first pipe line uniform so as to largely improve liquid remaining detecting accuracy and a constant quantity discharge accuracy. Further, the third pipe line 9 is provided with an accumulator 12 to substantially prevent the liquid 1 in the syringe from leaking without regard to the efficiency of the air suction 11.

In the aforementioned embodiment, the third pipe line 9 is provided with the suction solenoid valve 10, but alternatively, the discharge solenoid valve 3 can be directly connected to the air suction 11 and the reducing valve 6 in the pipe line can be omitted.

It is seen from the above description that, according to the present invention, the stand-up of the pressure in the first pipe line is steady without regard to variation of pressure supplied by the air supply 7. Therefore, the liquid in the syringe can be quantitatively discharged with very high accuracy independent of whether the liquid remaining in the syringe is much or less, and the remaining quantity of liquid in the syringe can be accurately detected to prevent stoppage of discharge owing to an empty syringe, and also to timely exchange the empty syringe with a new syringe filled with liquid. Moreover, the accumulator provided in the third pipe line serves to quickly reduce the pressure in the first pipe line to a predetermined negative pressure without regard to pulsation of the air suction.

What is claimed is:

1. A liquid dispensing apparatus comprising a syringe containing a liquid to be dispensed, an air supply for supplying compressed air to the syringe, a discharging solenoid valve connected to the syringe by means of a first pipe line and to the air supply by means of a second pipe line, a first pressure sensor for measuring pressure in the first pipe line, a second pressure sensor for measuring pressure in the second pipe line, and a controller connected to the discharging solenoid valve for outputting a signal to the discharging solenoid valve to communicate the first pipe line with the second pipe line and for controlling an output duration of the signal in accordance with a variation of time until the pressure in the first pipe line measured by the first pressure sensor reaches to a predetermined pressure after the first pipe line is communicated with the second pipe line, said apparatus further comprising an accumulator connected to the second pipe line, thereby preventing disturbance of the pressure in the syringe at the moment of communication between the first and second pipe lines.

2. An apparatus claimed in claim 1, wherein the discharge solenoid valve is arranged between the syringe and the air supply and adapted for communicating the syringe with the air supply when the liquid is discharged out of the syringe.

3. An apparatus claimed in claim 1 further comprising an air suction connected to the discharging solenoid valve by means of a third pipe line adapted for communicating with the first pipe line except when the first pipe line is communicated with the second pipe line and an accumulator provided in the third pipe line.

4. An apparatus claimed in claim 3, wherein an air suction solenoid valve is arranged between the discharging solenoid valve and the accumulator in the third pipe line and electrically connected to the controller.

5. An apparatus claimed in claim 1, wherein the first and second pressure sensors are electrically connected to the controller.

6. An apparatus claimed in claim 2 further comprising an air suction connected to the discharging solenoid valve by means of a third pipe line adapted for communicating with the first pipe line except when the first pipe line is communicated with the second pipe line and an accumulator provided in the third pipe line.

7. An apparatus claimed in claim 2, wherein the first and second pressure sensors are electrically connected to the controller.

8. An apparatus claimed in claim 3, wherein the first and second pressure sensors are electrically connected to the controller.

9. An apparatus claimed in claim 4, wherein the first and second pressure sensors are electrically connected to the controller.

* * * * *